US006511557B2

(12) United States Patent
Arvedi

(10) Patent No.: US 6,511,557 B2
(45) Date of Patent: Jan. 28, 2003

(54) PROCESS AND RELATIVE PRODUCTION LINE FOR THE DIRECT MANUFACTURE OF FINISHED PRESSED OR DEEP DRAWN PIECES FROM ULTRATHIN HOT ROLLED STRIP CAST AND ROLLED IN-LINE

(76) Inventor: Giovanni Arvedi, Via Mercatello 26, Cremona (IT)

( * ) Notice: Subject to any disclaimer, the term of this patent is extended or adjusted under 35 U.S.C. 154(b) by 0 days.

(21) Appl. No.: 09/817,228

(22) Filed: Mar. 26, 2001

(65) Prior Publication Data

US 2001/0011565 A1 Aug. 9, 2001

Related U.S. Application Data

(63) Continuation of application No. PCT/IT99/00018, filed on Jan. 27, 1999.

(30) Foreign Application Priority Data

Oct. 1, 1998 (IT) ..... MI98A002116

(51) Int. Cl.[7] ..... C21D 8/04

(52) U.S. Cl. ..... 148/546; 164/417; 164/476; 164/477

(58) Field of Search ..... 148/546; 164/418, 164/476, 477, 417

(56) References Cited

U.S. PATENT DOCUMENTS 4,269,632 A 5/1981 Robertson et al.
4,976,306 A * 12/1990 Pleschiutschnigg et al. 164/476
5,307,864 A * 5/1994 Arvedi et al. ..... 164/417
5,662,748 A * 9/1997 Mizoguchi et al. ..... 148/332
6,290,787 B1 * 9/2001 Babbit et al. ..... 148/541
6,321,828 B1 * 11/2001 Pleschiutschnigg ..... 164/268

FOREIGN PATENT DOCUMENTS

| | | |
|---|---|---|
| DE | 38 40 812 A1 | 4/1990 |
| DE | 195 13 999 A1 | 10/1996 |
| EP | 0 605 947 A1 | 7/1994 |
| EP | 0 863 222 A1 | 9/1998 |
| JP | 56122611 A | 9/1981 |
| WO | WO 98/00248 A1 | 1/1998 |

OTHER PUBLICATIONS

Schonbeck et al., State of ISP Technology And New Developments, *Stahl und Eisen*, vol. 116, No. 11, pp. 65–73, 158 (1996) No month.

Gosio et al., The Status of ISP At the Arvedi Works, Cremona, Italy, *La Revue de Metallurgie–CIT*, vol. 93, No. 4, pp. 551–566, (1996) No month.

* cited by examiner

*Primary Examiner*—Roy King
*Assistant Examiner*—Tima McGurthry-Banks
(74) *Attorney, Agent, or Firm*—Akin Gump Strauss Hauer & Feld, L.L.P.

(57) ABSTRACT

A process for the production of cold rolled finished strip with thickness of 0.5–0.1 mm and a maximum width of 2000 mm for direct preparation of end products such as pressed and deep drawn pieces from thin slab casting with a thickness of the bar leaving the mold of 90–50 mm, with preparation of pressed pieces and transfer of the finished pieces to the end user and return of the processing scrap to the steel manufacturing cycle. Also a production line for carrying out such a process is described.

4 Claims, 2 Drawing Sheets

PROCESS AND RELATIVE PRODUCTION LINE FOR THE DIRECT MANUFACTURE OF FINISHED PRESSED OR DEEP DRAWN PIECES FROM ULTRATHIN HOT ROLLED STRIP CAST AND ROLLED IN-LINE

CROSS-REFERENCE TO RELATED APPLICATIONS

This application is a continuation of International Application No. PCT/IT99/00018, filed Jan. 27, 1999, which was published in the English language on Apr. 13, 2000 under International Publication No. WO 00/20141.

BACKGROUND OF THE INVENTION

The present invention concerns a process and relative production line for the direct manufacture of finished pressed or deep drawn pieces from ultrathin hot strip cast and rolled in-line.

Worldwide production of hot rolled strip for the manufacture of cold rolled strip amounts to about 40% of world steel production which is currently about 750 million tonnes/year. This share of cold rolled steel production in industrial countries amounts to about 50%, however, from which it can be deduced that the growth potential for hot or cold rolled strip production is very high at a worldwide level.

At the same time it must be remembered that the investment costs for traditional production lines are very high and, on the basis of an integral cycle steel mill with a capacity of about 4 million tonnes/year, expressed in specific investment costs, amount to about US$ 1000/tonne of cold rolled strip.

A traditional process and production line for the manufacture of cold rolled strip with gauges from 0.6 to 0.1 mm, coated or non-coated, is composed for example, as shown in FIG. 1 relative to the prior art, of:

- blast furnace production (1);
- oxygen melt shop (2)—convertor;
- continuous slab casting plant with thickness 200–250 mm and width 800–2600 mm (3);
- hot rolling mill (4) composed of a furnace (4.1), a roughing mill (4.2) and a finishing mill (4.3) for the manufacture of hot strip in gauges between 4 and 2 mm and a maximum width of 1800 mm for the manufacture of cold rolled strip;
- continuous pickling (5);
- cold rolling mill (6), for example as a continuous or reversible rolling mill for the manufacture of gauges between 0.6 and 0.3 mm;
- annealing (7) of the continuous or bell type;
- cold finishing mill (skinpass mill) with temperature management and control (8).

This cold rolled strip, controlled as regards thickness, crown and flatness, will feed at choice: a tinning line (9) or a galvanizing line (10) or, without surface coating, a service centre directly (11) where, depending on customer requirements, it will be transformed in the form of strip or packs of sheet, depending on the orders, to then leave the factory (12) by transport on road, rail and/or water (13). This traditional form of selling finished cold rolled strip also involves the transport of the processing scrap (16) produced by those who carry out subsequent processing (14). This scrap derives, for example, from pressing or deep drawing (15) of finished parts such as, for example, assembly components (boxes, car and tank pieces etc.). This processing scrap (16), which currently amounts to about 15% of the whole of worldwide steel production, can be seen as a "steel tare" which is transported uselessly from the steel manufacturer (12) to the customer (14) to return once more to the steel manufacturer (12) and consequently implies transport costs in the form of time, energy and environmental pollution.

The customer (14) traditionally collects from the steel mill sheets or coils which are suitable for deep drawing and pressing, preferably with a carbon content below 0.06%. The customer unwinds them and puts them for example into a press (15) in order to obtain products (17) such as:

- press-processed pieces or
- deep drawn pieces such as, for example, external or internal parts for the construction of cars or lorries.

The scrap derived from processing (16), also defined as "new scrap", produced from the pressing of sheets at the customer's or end user's (14) and as a share of tare already amounts to about 30% of total scrap production, which currently corresponds to about 50% of world steel production, must be transported back to steel manufacturing, such as an oxygen melt shop (2) or an electric mill (2.1), causing consequent costs. This means that the scrap makes its way again to the steel manufacturer's to be recycled.

Moreover, this production line is characterized by a longitudinal dimension of about 1500–2000 meters and a transversal dimension of about 50 meters, calculated from the continuous casting plant (3) to shipment (11) of the cold rolled product in the form of coils (11.1) or packs of sheet (11.2). Moreover, each manufacturing phase is generally equipped with an uncoiling and coiling station which in addition causes expenditure of work, loss of energy and material, as well as possible operating anomalies, and also requires space for storage and moving the coils between one production phase and the subsequent one.

An initial shortening of the casting and rolling processes, and therefore a cost reduction in the price per tonne of hot rolled strip of about 50%, could be achieved with the introduction of the thin slab technique together with the continuous finishing mill. As regards this, the so-called ISP (In-line Strip Production) process in particular, with the components of the cast-rolling technique, i.e. slab thickness reduction during and immediately after the solidification phase, is to be cited (DE 38 40 812, DE 38 18 077, DE 44 03 048 and DE 44 03 049). This technology, compared with other thin slab technologies which show no thickness reduction, leads to a reduction of up to 50% during the solidification phase and up to 80% directly after solidification, a better surface quality and, at the same time, a finer crystalline structure, improved internal quality and, therefore, considerably improved properties of the material in the end product.

In the ISP process (23.4) for example, which is represented in part of FIG. 2, the slab casting thickness (18.3) in the thin slab casting plant (18) is reduced during solidification in the roll table (18.2) from a thickness of 65 mm on leaving the mold (18.1) to a minimum thickness of 30 mm. Directly after solidification the slab thickness is reduced to as low as 6 mm by means of a rolling process, for example through three small stands (19) with an entry speed from 0.066 to a maximum of 0.15 m/s.

These cast-rolling technologies during and directly after solidification produce slabs with very good surface characteristics and a central-symmetrical and controlled convexity (crown) for example of 1.0–1.5% on a thickness of 6–25 mm, good flatness as well as a uniform grain size structure with minimum degrees of slab deformation from 30 mm to a minimum thickness of 6 mm or with a lengthening of 5 times.

The good production of the thin slab (18.3) and above all of the intermediate strip (19.1) in its shape and structure is to be traced back to the rolling in casting during solidification and above all to the rolling process after solidification which is characterized by a considerable transversal flow of the thin slab to be rolled in the pass between the rolls. This transversal flow is caused by the low deformation speed and the low resistance to rolling in the transversal direction of the material from thin slabs. Moreover, the good behaviour of the flow of the rolling material (18.3) in the pass between the roughing mill rolls (19) is directly favoured, after solidification, by the low deformation force at the high average temperature of 1350° C. in the cross-section of the slab. Moreover, the slab (18.3) with a surface temperature of about 1200° C. on entry to the first rolling stand of the roughing mill (19) still has a thermal gradient, i.e. a temperature increase in the direction of the slab nucleus.

This external and internal temperature between the solidification point and entry to the first stand is controllable by cooling and favours a current of the uniform mass on the cross-section of the slab in the pass between the rolling cylinders: i.e. it allows a uniform degree of deformation on the slab thickness or better on the thickness of the material to be rolled. This intermediate product (19.1), cast and rolled during and directly after solidification, presents the following characteristics:

thickness of 6–25 mm;

width of 700–2000 mm;

central symmetrical crown between 1.0 and 1.5%;

central symmetry of the convexity >95% (wedge) on the width of the material to be rolled;

high degree of flatness of the material to be rolled;

better surface quality, which meets the high demands for the deep drawing (05/05) of external automobile parts;

uniform, homogeneous and transversally fine crystalline structure which leads to high resistance and toughness as well as excellent ductility for good cold deformation;

This intermediate rolled product (19.1) manufactured in this way with its positive characteristics, which a rolled product produced according to the prior art does not usually show, with a thickness of 25–6 mm derived from the traditional slab between points (3) and (4.6) having a thickness of 280–150 mm, or from a conventional thin slab with a thickness of 50 mm, is now heated, preferably by means of an induction furnace (21), to an optimal temperature in relation to the form of rolling which is determined by:

the steel grade;

the final rolling thickness;

management of the hot strip temperature in the rolling mill (23) between the first and the n-th stand as also in the cooling line (23.1) and in the hot rolled strip coiler (23.2);

recrystallization and formation of the structure with respect to the material and its behaviour in the T.T.T. diagram (time-temperature-transformation);

crown;

flatness

To be then taken directly or again coiled into an intermediate coil (22) at the rolling mill (23) for example by means of a form of continuous rolling without longitudinal cutting of the slab (18.3). In the rolling mill (23) the hot strip (23.3) with a thickness between 1.2 and 0.6 mm finally reaches the hot strip coiler (23.2) for recrystallization, from where it is then taken to other processing processes at the cold rolling mill (25) with or without subsequent surface coating.

BRIEF SUMMARY OF THE INVENTION

The task of the invention is now that of considerably simplifying the traditional hot rolled strip production process described above and based on the traditional slab or even on a normal thin slab (FIG. 1) with the help of the ISP process (23.4) and a rolling product with a thickness of 0.6–1.2 mm, saving stages in the process, reducing costs and having the possibility of directly preparing, subsequently to the rolling process, for example finished pressed or deep drawn pieces such as details for a car door, pieces which are then supplied as finished products (32) to the end user i.e. the car manufacturer for final assembly.

This technology would lead to savings in the following sectors:

investment costs;

manufacturing costs:

- energy
- a material
- a salaries and wages
- transport cost per piece as well as improvements as regards environmental pollution, supported by:

savings in the annealing process;

savings in transport energy and better exploitation of the material (recycling).

The ISP process (23.4), together with processes according to the present invention which include the further processing of the material, leads to an innovative solution of the problem, characterized by the claims of the process and the production lines.

The present invention will now be described in greater detail with reference to an example of embodiment on the basis of the attached drawings in which:

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

Figure 1:
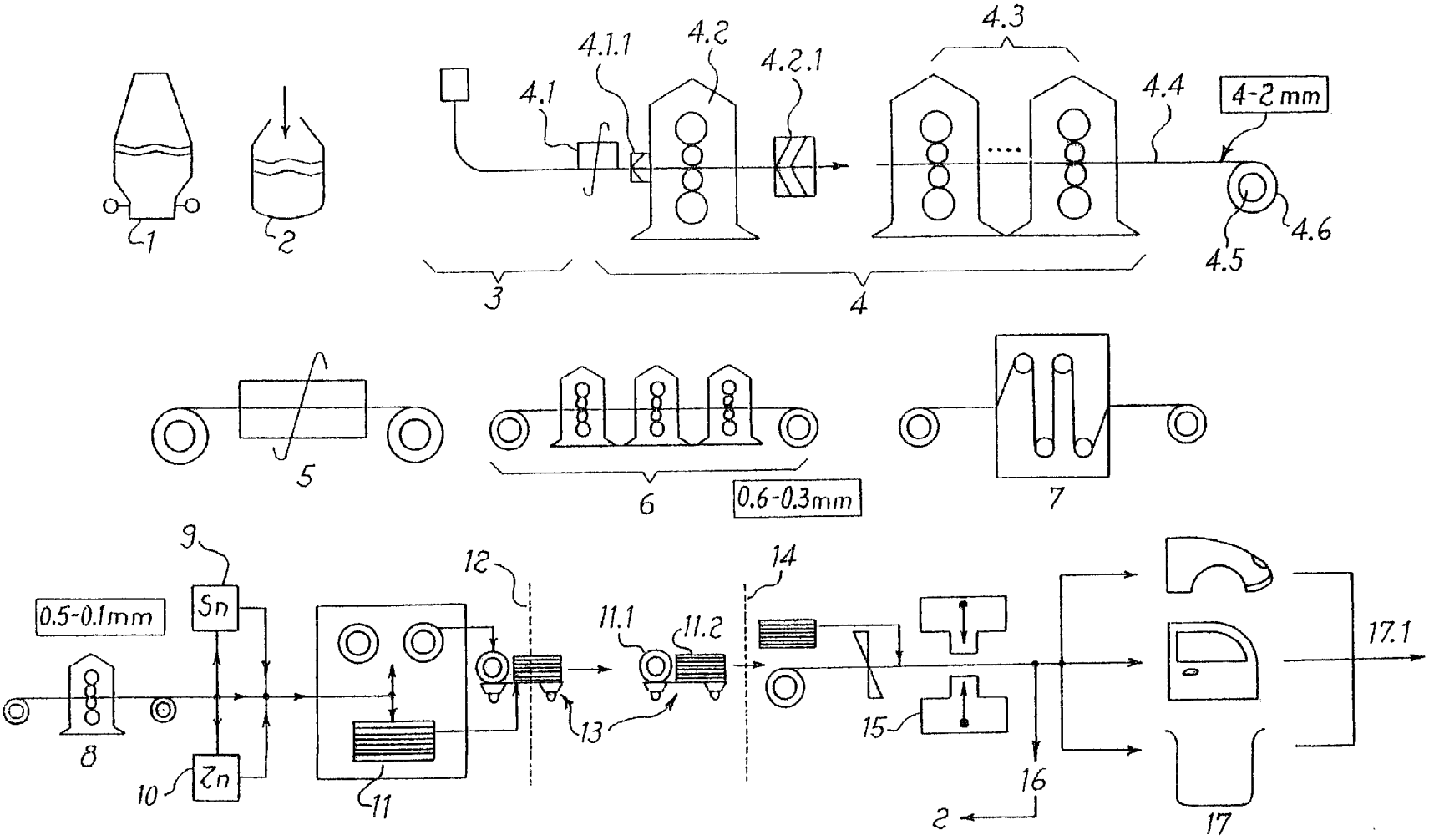
Fig. 1 PRIOR ART
FIG. 1 shows a schematic diagram of a traditional process method and relative production line for the manufacture of cold rolled products and finished products derived therefrom, as already exhaustively described, which describes the present state of the art; and, FIG. 2 shows a schematic diagram of an inventive combination of the process and the production line for the manufacture of cold rolled finished products based on the casting of thin slabs with the cast-rolling technique during and after solidification.
Figure 2:
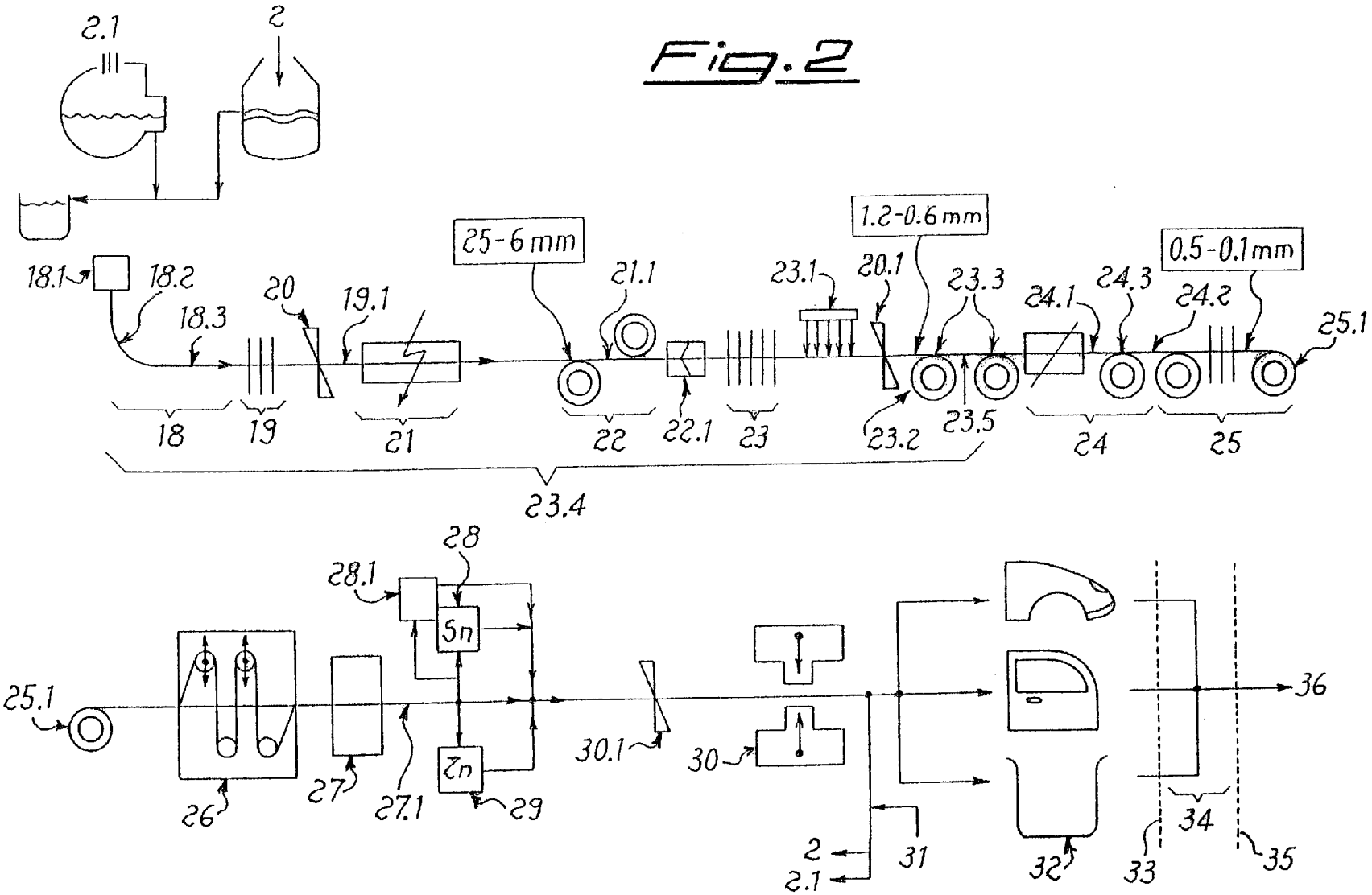

The tests conducted on an ISP plant which represent the bases of the process and the production lines according to the invention are described with the aid of FIG. 2.

The newly invented process and production line presuppose the melting of the steel in a BOF oxygen (converter) (2) or electric (2.1) melt shop and are based on a thin slab plant (18) with a thickness on leaving the mold (18.1) for example between 50 and 90 mm and for example with a thickness reduction during solidification to 30 mm minimum. A small roughing mill (19) is connected to the continuous casting plant directly in-line and passes the thin slab (18.3) with a casting speed of about 4–8 m/min thus producing a high transversal flow of the rolling material (18.3) in the passage between the rolling cylinders. By means of this transversal flow and, not least, by means of the controlled thermal gradient between the slab surface and the slab nucleus, a very good and symmetrical crown is obtained on the roughed strip (19.1) equal to 1.0–1.5% as well as a fine and uniform structure of the material on the strip cross-section.

The intermediate strip (19.1) at the end of the roughing mill (19) has a thickness of 25–6 mm and can be cut with the shear (20) into coils with a specific weight of 15–25 kg/mm width. After the roughing mill the intermediate strip (19.1) preferably flows into an induction furnace (21) by means of which it is brought to an optimal temperature for the end product depending on the steel grade, the strip thickness and the desired structure of the material or rather the desired properties of the material. Following the temperature control the strip with rolled structure rolls into an intermediate coiler (22) where the specific temperature of the coil can be balanced again during the time the strip stays in the coiler.

It is also possible to achieve continuous rolling (21.1) in such a way that the strip (19.1), without coiling into an intermediate coil, is taken directly to the descaler (22.1) and the finishing mill (23). The intermediate strip (19.1) leaves the continuous roller table (23) as a hot strip (23.3) with a thickness of 1.2–0.6 mm and a width o 700–2000 mm, passes through the cooling area (23.1) with the aim of controlling the structure according to the T.T.T. diagram and passes through a shear (20.1) to be then wound into a hot coil (23.2). This hot strip (23.3) is taken to and maintained at a controlled temperature along the whole rolling line between the induction furnace (21) and the coiler for hot strip (23.2) in such a way as to maintain a controlled recrystallized and uniform structure as per the T.T.T. diagram. This hot strip (23.2), with its structure (23.3) controlled, can then, after pickling (24) be sent directly (24.2) or through intermediate coiling (24.3) to the cold rolling mill (25).

Moreoever, the hot strip (23.3) can also be sent directly (23.5) to pickling without being wound on the coiler for hot strip (23.2).

In the cold rolling mill (25) the hot strip is cold rolled down to a thickness of 0.5–0.1 mm. After the cold rolling stage the strip (25.1) is taken to a cold finishing mill (27) with temperature management (26). After passing through the cold finishing mill (skinpass mill) (27) the strip is controlled as regards:

thickness
crown
flatness
structure and taken directly to a surface coating line such as, for example, a tinning line (28), a galvanizing line (29), an organic coating line (28.1) or without a coating directly to a press (30). Here the finished products (32) are prepared directly at the steel manufacturer's, or rather at the cold rolled steel manufacturer's, products such as:

pressed elements
deep drawn elements and the processing scrap (31) produced in the pressing process can be sent directly and therefore recycled at the steel melting process (2) or (2.1) with savings in transport costs and transport energy.

Leaving the steel manufacturer's factory door (33) are finished products, net-finished pieces (32) without "steel tare" (31) wich can be taken directly to the customer's (35) for final assembly (36).

If the traditional production method is compared with the new inventive solution, it can be seen that through production of very thin, recrystallized, hot rolled strip (23.3) in gauges between 1.2 and 0.6 mm, for example with ISP technology (23.4), very thin strips (25.1) can be produced in the cold rolling mill (25) in gauges 0.5–0.1 mm. This thin cold strip (25.1) is processed directly in the cold finishing mill (27) with temperature management (26) in order to obtain the finished product (27.1) without having to use a traditional continuous annealing furnace with long control times of the material temperature.

The ready cold strip manufactured in this way (27.1) can then at choice be introduced into surface coating lines (28), (28.1) and (29) and/or fed directly to the press (30) for the production of finished pieces (32). This preparation phase (30), directly connected to the cold rolling mill (25) and the cold finishing mill (27) for the production of finished pieces (32), again leads to a reduction in energy, transport costs and environmental pollution.

The technical process invention with its relative production lines, compared with the traditional preparation line based on the traditional slab or the thin slab without thickness reduction during and after solidification, leads to a very thin hot strip (23.3), precise in its geometrical and recrystallized form, with a thickness between 1.2 and 0.6 mm and a crown between 1.0 and 1.5% or 10–15 microns which, after pickling, allows production of a finished cold rolled and ready strip (27.1) without traditional annealing. This ready cold strip rolled in this way, which implies low costs, is taken coated or not coated, directly to the press (30) for the production of the finished products (32) where, with the recycling of the processing scrap (31) in the melt shop nearby, further costs are saved.

The savings and/or advantages of the inventive new process with its relative production lines are:

annealing, bell or continuous annealing, after cold rolling;
transport costs for the processing scrap due to production of the finished product (32) at the steel manufacturer's instead of the end user's (35), as usual up to now; and
savings in the following fields:
investment costs
manufacturing costs
energy
material
salaries and wages
transport
cost per piece.

What is claimed is:

1. A process for the manufacture of cold rolled and finished strip in gauges 0.5–0.1 mm and a maximum width of 2000 mm for the direct preparation of end products, comprising the following steps:

casting thin slabs leaving a mold to a thickness of 90–50 mm;
reducing the slab thickness to a minimum of 30 mm during a solidification phase;

further reducing the slab thickness to a minimum of 6mm with a central symmetrical crown of 1.0–1.5% directly after the solidification phase while connected to a casting process during a roughing stage;

regulating and controlling a temperature of the further reduced slab directly after the roughing stage;

producing a cast-rolled product controlled as to temperature, thickness, width, crown and flatness;

finishing rolling in order to obtain a recrystallized hot coil with a thickness of 1.2–0.6 mm and a crown of 1.0–1.5%;

pickling the coil with subsequent cold rolling for production of a cold strip of a thickness between 0.5 and 0.1 mm;

cold finishing by a skinpass step preceded by temperature management for control of structure of the strip;

further comprising in-line pressing of finished, ready to be used pieces with return of processing scrap to a steel manufacturing cycle; wherein an intermediate strip is hot rolled directly in a finishing mill without intermediate winding through a coil-box and a hot strip is sent directly without intermediate winding in a down-coiler; and further comprising coating the cold rolled strip between the cold finishing and pressing steps.

2. The process of claim 1, wherein the end products are pressed or deep drawn pieces.

3. If. A production line for carrying out the process of claim 1, comprising:

a thin slab plant with a hydraulically operated oscillating mold in which the cast thin slabs have a thickness on leaving the mold of between 90 and 50 mm, a maximum width of 2000 mm and a maximum casting speed of 10 m/min;

a roller table comprising exclusively rolls which allow a thickness reduction of the slabs during solidification to a minimum of 30 mm;

a roughing mill comprising of at least one stand, connected directly and in-line with a continuous casting plant for reduction or roughing of the slab to a roughed strip thickness from 25 mm to a minimum of 6 mm;

a furnace for temperature control of the intermediate strip directly after the roughing mill;

a finishing mill comprising at least four stands, a cooling table and a coiler for hot strip;

a pickling unit with a cold rolling mill attached for production of cold rolled strips in gauges 0.5–0.1 mm;

a finishing mill with a temperature control;

further comprising a press directly connected to the finishing mill for production of finished products ready to be used, wherein between the roughing mill and the finishing mill the intermediate strip is hot rolled directly in the finishing mill without passing through an intermediate coil-box and the hot strip is sent directly to picking without being wound in a downcoiler; and further comprising a strip coating plant between the cold finishing mill and the press.

4. A production line according to claim 3, wherein the furnace is an induction furnace.

* * * * *